US005904021A

United States Patent [19]

Fisher

[11] Patent Number: 5,904,021

[45] Date of Patent: May 18, 1999

[54] MODULAR FLOORING RECREATIONAL USE

[76] Inventor: Kirk R. Fisher, 806 Roxbury Dr., Fullerton, Calif. 92833

[21] Appl. No.: 08/902,271

[22] Filed: Jul. 29, 1997

[51] Int. Cl.[6] ..... E04F 15/02; E04F 15/00; A63C 19/04

[52] U.S. Cl. ..... 52/578; 52/177; 52/592.2; 472/92

[58] Field of Search ..... 52/177, 592.2; 472/92

[56] References Cited

U.S. PATENT DOCUMENTS 3,960,375 6/1976 Bibi-Roubi et al. ..... 272/3
4,008,548 2/1977 Leclerc ..... 52/180
4,054,987 10/1977 Forlenza ..... 29/452
5,323,575 6/1994 Yeh ..... 52/177

*Primary Examiner*—Christopher Kent
*Assistant Examiner*—Brian E. Glessner
*Attorney, Agent, or Firm*—Edgar W. Averill, Jr.

[57] ABSTRACT

A modular flooring surface freely supported on the upper surface of a flat floor. The modular flooring surface is made up of shaped tiles which snap together to form a playing surface for sports such as roller hockey, tennis, basketball and the like. The tiles of the flooring surface are preferably not rectangular in shape and thus, the resulting playing surface has no long straight seams. The flooring surface preferably has a pattern formed so that it is not completely smooth but instead has small ridges extending upwardly from a base. A preferred shape of modular tile of the playing surface is hexagonal.

12 Claims, 6 Drawing Sheets

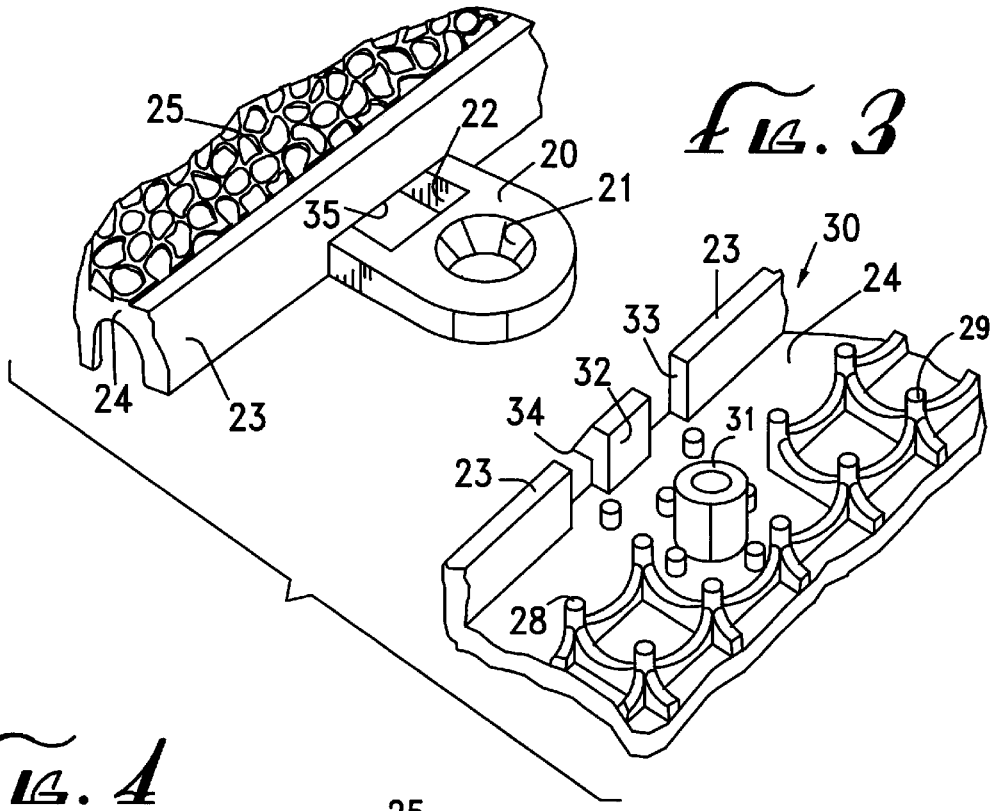
FIG. 3
FIG. 4
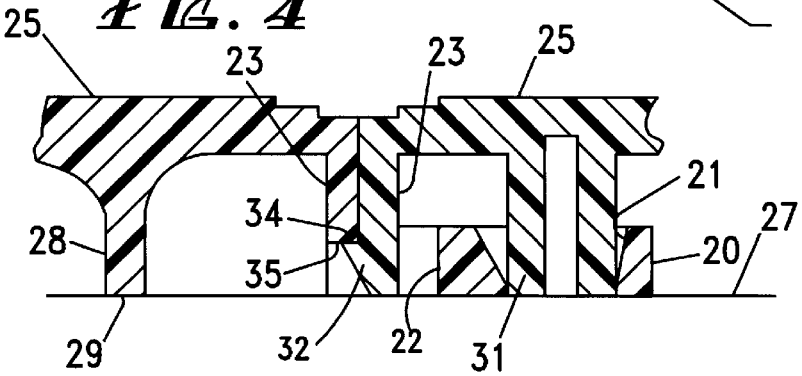
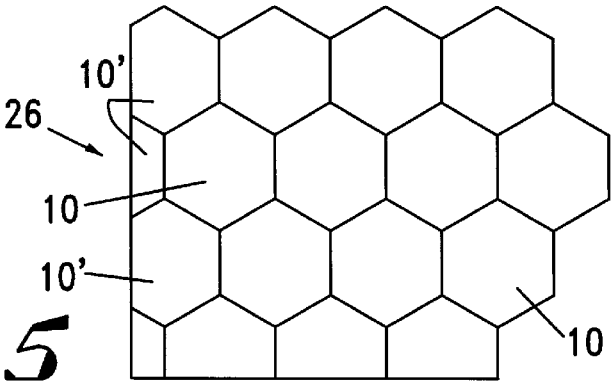
FIG. 5

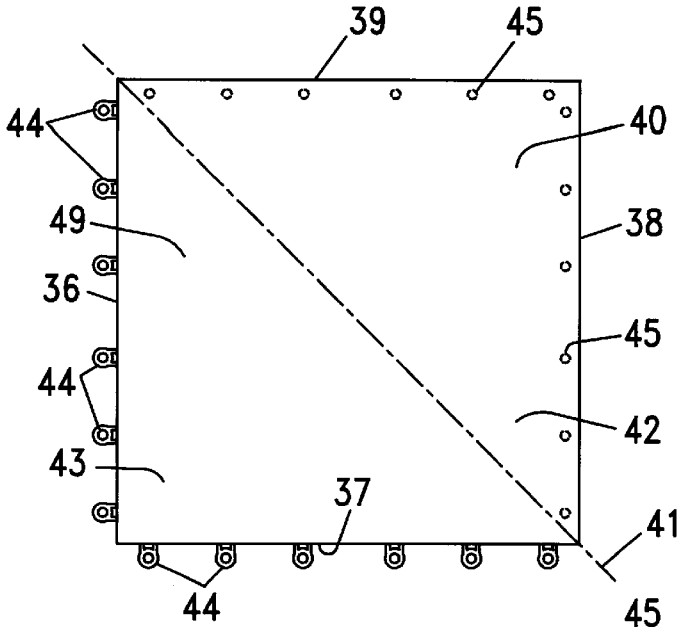
FIG. 6
PRIOR ART
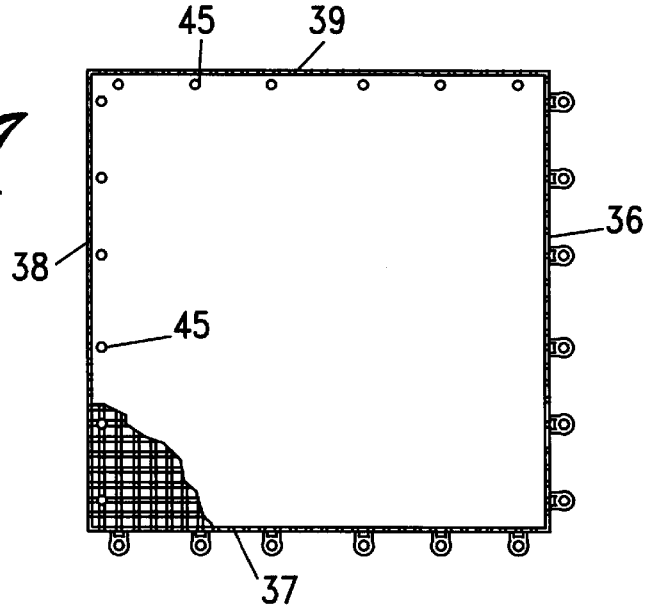
FIG. 7
PRIOR ART
FIG. 8
PRIOR ART
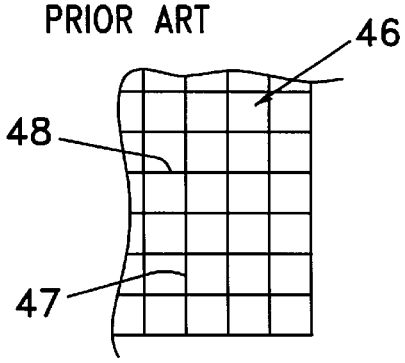

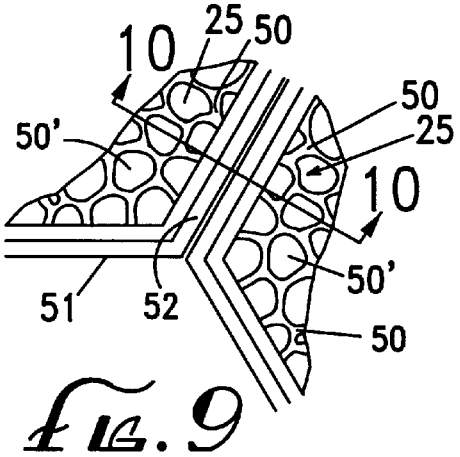
FIG. 9
FIG. 10
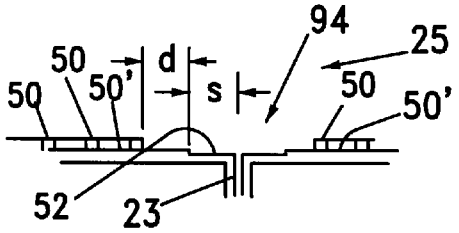
FIG. 11
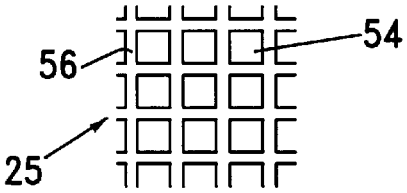
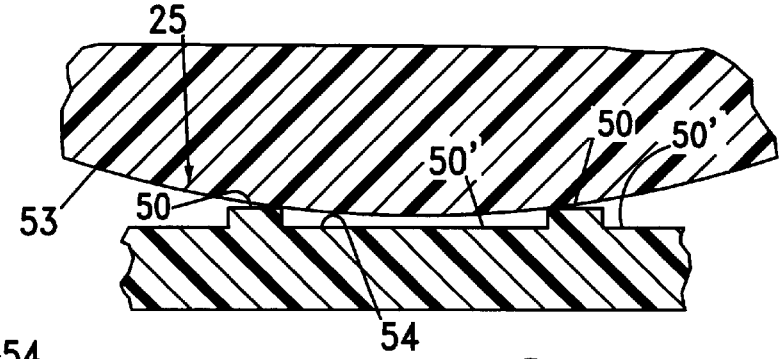
FIG. 12
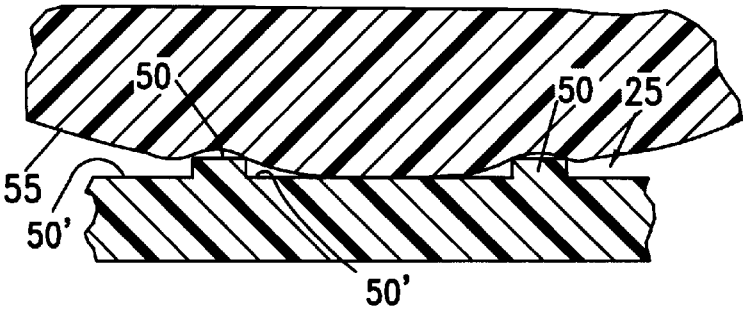
FIG. 13

MODULAR FLOORING RECREATIONAL USE

BACKGROUND OF THE INVENTION

The field of the invention is flooring surfaces for recreational use. Numerous designs are in use and perhaps the most popular design is sold under the trademark "Sport Court". One design of this flooring is shown in FIGS. 6, 7 and 8 of the drawings where a square tile having a playing surface 1'×1' has outwardly extending interlocking members on two of the sides and inwardly extending interlocking members on the other two sides. The inwardly extending members have pegs which interlock with the outward extending members to form a uniform playing surface. Because the tiles are square, however, long straight seams are formed over the playing surface and particularly in the sport of roller hockey, these long straight seams can interfere with the play of the sport, as well as to create a weak point where the floor buckles when it expands. While some designs of the "Sport Court" brand of playing surface are open in a lattice design, the prior art style most popular for use in the sport of roller hockey has a generally smooth flat playing surface. A generally smooth playing surface tends to create a tendency for the wheels of the inline skates of the skater to slip or skid but speeds the sliding of a roller hockey puck. A rougher playing surface slows and shortens the travel of the puck but permits the skater to make sharper turns without slipping. Because of the difficulties caused to the skater, an improved design would be beneficial.

Ice hockey has been a major sport for many years. Roller hockey is a relatively new sport which utilizes inline skates and a plastic puck. With ice hockey the puck moves quickly on the ice surface and the skater moves quickly and has the ability to make sharp turns without skidding. It would be ideal to simulate these two benefits for the sport of roller hockey. In roller hockey the puck moves slower as more friction is created by the floor surface and moves faster as the friction is reduced. With ice hockey, the skater is able to turn or stop very quickly because his skates dig into the ice surface. This does not occur with inline skates. Until now there has not been a floor for roller hockey that provides both a fast puck movement and the ability for the skater to grip the floor surface for sharper turns. For instance, with asphalt the skater is able to grip the surface and thus, turn quickly, but the puck moves very slowly because of the high friction. Likewise, with a wood surface, the skate wheels grip the wood surface very well but the puck moves relatively slowly. With normal cement, once again the skater can turn quickly but the puck is slow. A painted or roll-on cement surface can be made either to provide a slow puck and a fast skater or a fast puck but a slippery surface. In the plastic squares commonly used in the sport of roller hockey, the puck surface is slippery for the skater who is thus unable to turn quickly.

Several patents have been issued on modular flooring. One is shown in U.S. Pat. No. 3,960,375 which has the outwardly extending and inwardly positioned interlocking members which snap together to form the modular playing surface. Another design is shown in U.S. Pat. No. 4,008,548 which also has an open surface and interlocks to form the modular playing surface. U.S. Pat. No. 4,054,987 shows yet another open surface design with interlocking pegs and outwardly extending members.

BRIEF SUMMARY OF THE INVENTION

It is an object of the present invention to provide a modular flooring surface which eliminates the long straight seams of prior art playing surfaces and which also has a raised ridge design on an otherwise flat (and preferably sand blasted) upper playing surface to improve the play of roller hockey.

The present invention is for a modular flooring surface freely supportable on the upper surface of a flat floor. The modular flooring surface is of the type made of identically shaped tiles, each tile having an upper surface plate with an upper playing surface. The upper surface plate is supported above the flat floor. Half of the tile has outwardly extending interlocking means and the other half of the tile has inwardly positioned pegs and latches to interlock with adjacent tiles. The improvement of the present invention is that the tiles are not rectangular in shape but are preferably hexagonal or another shape which eliminates long straight seams in an assembled floor. The upper surface of each tile preferably has a plurality of raised ridges above a flat surface.

BRIEF DESCRIPTION OF THE DRAWINGS

FIG. 3 is an enlarged perspective view showing an outwardly extending interlocking member of the tile of FIG. 1 together with the underside of an adjacent tile showing the inwardly extending interlocking member which snaps into the outwardly extending interlocking member.

FIG. 4 is a cross-sectional view of the two interlocking members snapped together.

FIG. 5 is a plan view of an area of the playing surface of the flooring of the present invention.

FIG. 6 is a top view of a prior art tile.

FIG. 7 is a bottom view of a prior art tile.

FIG. 8 is a plan view of an area of the playing surface of the prior art flooring of FIG. 7.

FIG. 9 is a top view of a corner of two tiles of FIG. 1 enlarged and showing a raised surface design thereon.

FIG. 10 is a cross-sectional view taken along line 10—10 of FIG. 9.

FIG. 11 is a top view of an alternate raised surface design of the tile of the present invention.

FIG. 12 is an enlarged cross-sectional view of a portion of a tile of the present invention and the lower portion of a puck runner.

FIG. 13 is an enlarged cross-sectional view of a portion of a tile of the present invention and the lower portion of an in-line skate wheel.

DESCRIPTION OF THE PREFERRED EMBODIMENTS

Figure 1:
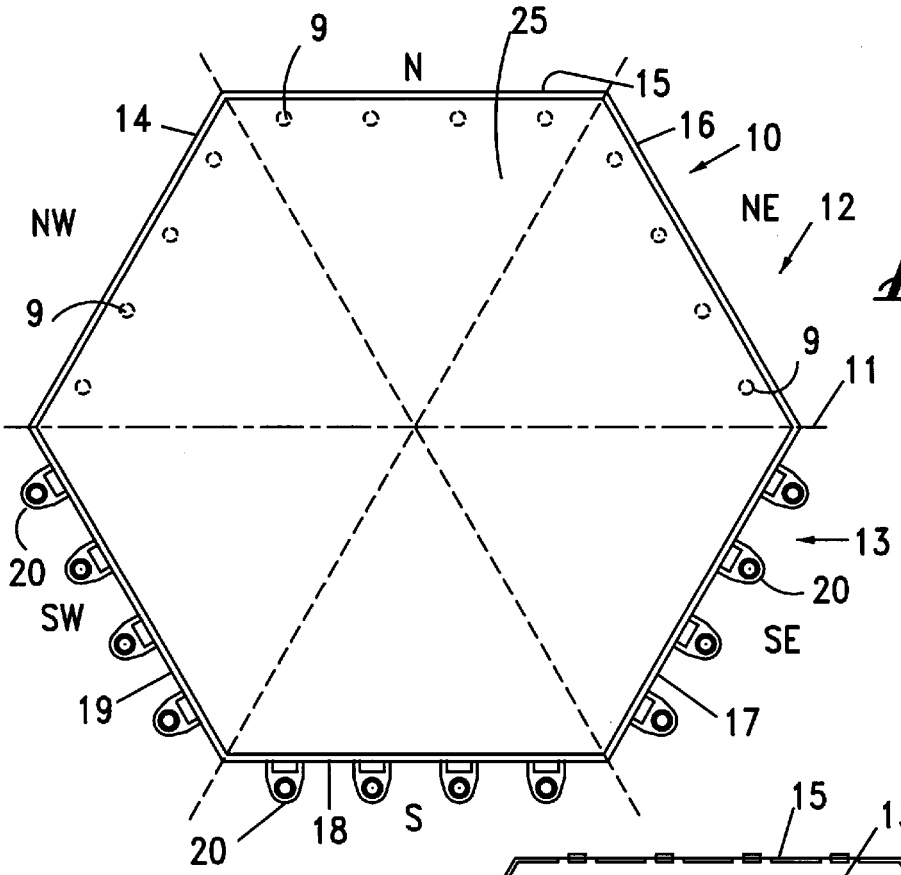
FIG. 1 is a plan view of the tile of the present invention which can be joined with adjacent tiles to form a modular flooring surface.
Figure 2:
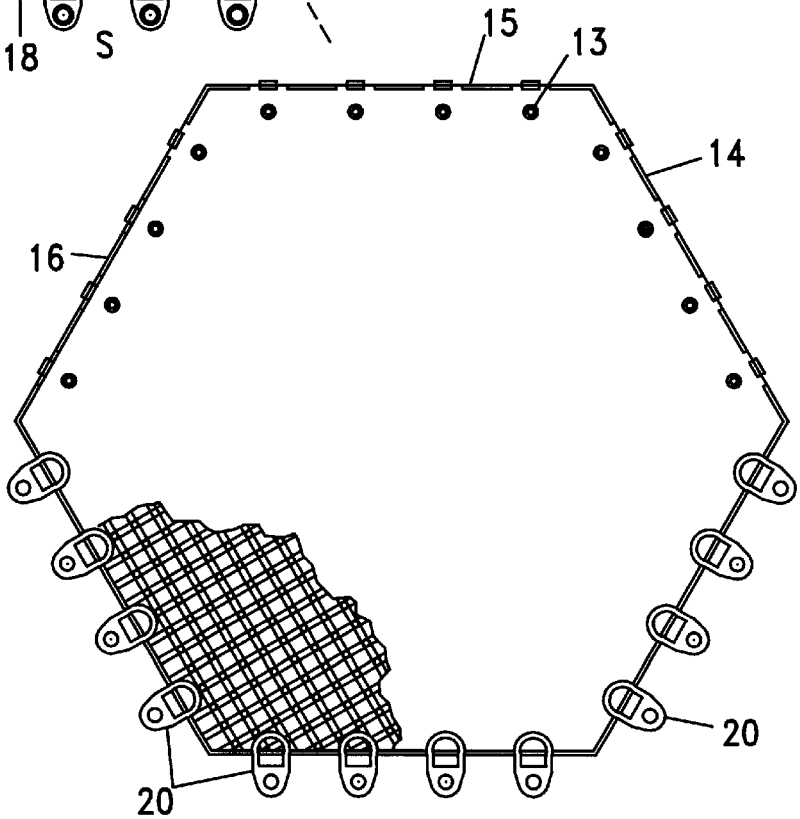
FIG. 2 is a bottom view of the tile of FIG. 1.

A tile of the present invention is shown in FIG. 1 and indicated generally by reference character 10. Tile 10 is hexagonal in shape and may be divided by a dividing line 11 into a north half 12 and a south half 13. The north half 12 has three edges 14, 15 and 16, each having four inwardly extending interlocking means 9. South half 13 has three sides 17, 18 and 19, each of which have four outwardly extending interlocking loops 20.

The detail of the interlocking of an individual loop 20 with the inwardly extending interlocking means 9 is indicated in FIGS. 3 and 4. Loop 20 has a frusto-conical opening 21 formed in the outermost portion thereof and a slot 22 formed adjacent a downwardly depending side 23. The upper surface plate is indicated by reference character 24 in FIG. 3 and the top of it is shown in FIG. 1. Upper surface plate 24 has an upper play surface 25 which, with adjacent tiles forms the modular flooring surface 26 shown in FIG. 5.

As shown in FIG. 5, the tiles may be cut to form any desired playing surface shape as indicated by cut tiles 10'. The upper surface plate 24 is supported above a flat floor 27 as shown in FIG. 4. The support is by a plurality of support stems 28, each of which end in a small support sole 29 which rests on flat floor 27.

Returning to the interlocking of adjacent tiles of FIG. 3, the inverted portion 30, shown in the right hand side of FIG. 3, has a peg 31 extending downwardly from the upper surface plate 24. A tab 32 is formed in a doorway 33 in the downwardly depending side 23. Peg 31 and tab 32 comprise interlocking means 9. Tab 32 has an outwardly extending catch 34. When the pieces of FIG. 3 are joined together, the inverted portion 30 is turned 180° and the peg 31 is inserted in the wide opening of frusto-conical opening 21 and tab 32 is inserted into slot 22. As the peg and tab are pushed downwardly they snap into place as shown in FIG. 4 where it can be seen that the catch snaps under the slot edge 35. Because opening 21 is tapered, this helps guide peg 31 snugly into opening 21 and helps to pull adjacent tiles closely together as shown in FIG. 5.

The individual tiles of the present invention are preferably injection molded from any suitable polymer depending upon the intended use. It has been found that polypropylene provides an appropriate combination of strength and may be injection molded although other polymers can, of course, be used.

The prior art flooring is shown in plan view in FIGS. 6 and 7 and a portion of the modular prior art floor is shown in FIG. 8. In FIG. 6 the prior art tile is indicated by reference character 40 in a top view and it too is intersected by a dividing line 41 into a north half 42 and a south half 43. South half 43 has two sides 36 and 37, each of which have six outwardly extending interlocking loops 44. The north half 42 has two sides 38 and 39, each of which have six inwardly extending interlocking means 45 on each of its two sides shown best in FIG. 7. When the prior art tiles are snapped together, a modular flooring surface is created as indicated by reference character 46 in FIG. 8 which can be seen to have a plurality of straight seams such as seams 47 and 48. These seams can be disconcerting in the playing of some games such as roller hockey. The top surface 49 of the prior art modular tile is generally smooth. This smoothness can cause the skater's wheels to skid sidewardly out of control as a skater makes a sharp turn.

As shown in FIG. 9, a raised design 50 has been formed on the play surface 25 of the portion 51 of a tile similar to that shown in FIG. 1. Thus, play surface 25 has two levels, a generally flat lower portion 50' and a raised upper surface 50. This raised design is called a reverse cobblestone design. The raised design is preferably formed of thin ridges or raised members, although it could be discreet squares, circles or other shapes. These raised members preferably should cover less than half of the play surface and ideally about 20% of the play surface. They should extend no more than about one to three-thousandths of an inch from the play surface and ideally about 0.0015". The distance across a preferred typical "reverse cobblestone" is about 1/16th of an inch. The effect of these raised members is remarkable in the playing of the game of roller hockey both with the faster sliding of the puck as well as the gripping between the inline skate wheels and the play surface are both immensely improved. The raised members 50 are, of course, injection molded into the play surface. The ridges are preferably about 0.020" wide and spaced no further apart than about 0.100". The height and spacing is such that the runner 53 of a puck never touches the flat lower portion 50' of the play surface 25 (which includes the ridges 50 and the flat lower portion 50'). The height and spacing is also such that the wheel 55 rides largely on the flat lower portion 50'. By the use of the above-described ridges, it has been found that skaters can use a harder wheel as compared to the hardest wheel practical on the smooth prior art flooring of FIG. 8. Whereas a skater could use a wheel no harder than about 76 Shore A on the prior art floor, a hardness of 81 or 82 Shore A can be used on the flooring of the present invention including the raised ridges 52. A harder wheel is faster and thus, desired by skaters.

Preferably the generally lower flat lower portion 50' is roughened so that the wheel will have an optimal grip on the roughened portion. Also preferably the raised upper surface 50 is smoothly polished to reduce the friction of the puck that rides on this upper surface. Also preferably the walls of the raised design are about vertical and the raised upper surface is flat. The roughened flat lower portion can be roughened by sand blasting the mold.

Whereas a random design of ridges 50 is shown in FIGS. 9 and 10, a regular design of ridges 56 may be used as shown in FIG. 11. These ridges 56 surround a roughened lower surface 54. These ridges 56 also should cover no more than about 50% of the play surface 25 and preferably about 20%. They should also have a height of no more than about 0.003" and preferably about 0.0015". Also, the ridge width is preferably about 0.020".

Prior art tiles have an essentially flat upper surface which extends to a right angle at its intersection with its downwardly depending side. The design of the present invention preferably has a step 52 adjacent the intersection of the flat surface 50' and the downwardly depending side 23. This step should be about 0.020" wide and serves to eliminate any interruption in the smooth sliding of the puck at the intersection between tiles. The width of step 52 is indicated by "s" in FIG. 10. Furthermore it is preferable that the raised rib 50 terminate a distance "d" from the start of step 52. Distance "d" need only be about 0.020" and serves to eliminate any ridge breakage at the edge.

It has been found that a hexagonal shape provides a playing surface with no long linear seams. Various hexagonally-based shapes can be made, all of which eliminate long straight seams. Turning to FIG. 1, the hexagon has been divided into six segments indicated by the compass directions north (N), northeast (NE), southeast (SE), south (S), southwest (SW) and northwest (NW).

Figure 14:
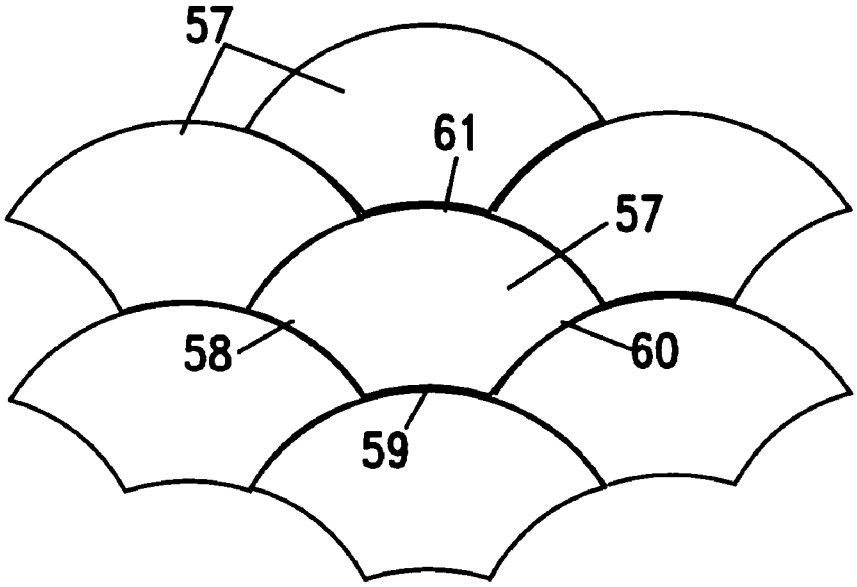
FIG. 14 is a top view of an alternate configuration of a plurality of tiles of the present invention.
Figure 15:
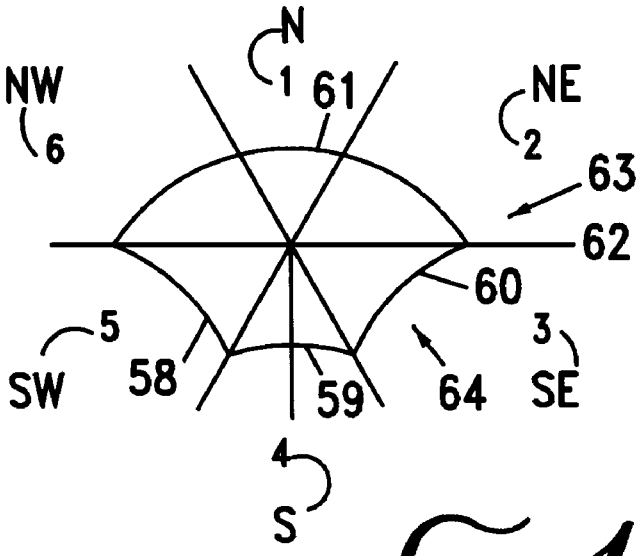
FIG. 15 is a top view of one tile of FIG. 14.

While straight-sided tiles have been discussed above, the tiles may have curved sides such as tile 57 of FIG. 14. Tile 57 has four curved sides 58, 59, 60 and 61. As with tile 10, it can be divided along dividing line 62 into a north half 63 and a south half 64. It can also be divided in six segments as shown in FIG. 15, N, NE, SE, S, SW and NW. The N segment abuts the adjacent S side of an adjacent tile. The NE side abuts an adjacent SW side.

Figure 16:
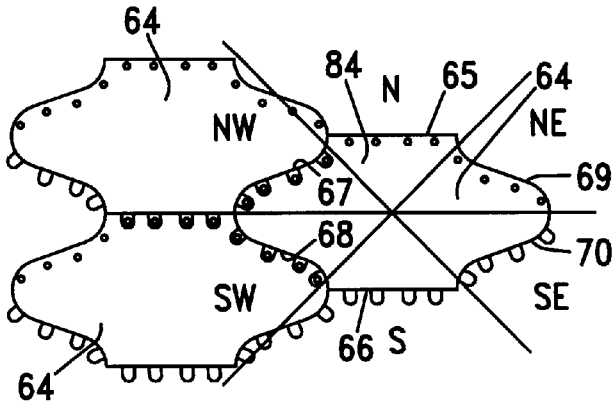
FIG. 16 is a top view of a plurality of still another alternate configuration of the tile of the present invention.

As shown in FIG. 16, the tile 64 may have a combination of straight sides 65 and 66 and two curved sides 67–68 and 69–70. These sides are also indicated by the compass points: N, NE, SE, S, SW and NW. These sides abut in the same manner as described for tile 10 or 57.

Figure 17:
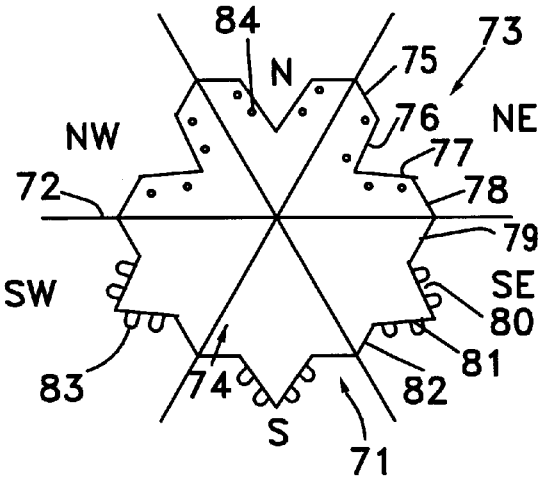
FIG. 17 is a top view of an alternate embodiment of a tile of the present invention.

A still further configuration is shown in FIG. 17 where tile 71 is divided by line 72 into a north half 73 and a south half 74. The north half has three identical segments NW, N and NE and the south half has three identical segments SW, S and SE. Each north half segment has four sides 75, 76, 77 and 78, with sides 76 and 77 forming a notch. Each south half segment also has four sides 79, 80, 81 and 82. As above the NE side of one tile abuts the SW side of an adjacent tile, etc. The south half of tiles 64 and 71 has outwardly extending interlocking means 83 and the north half has inwardly extending interlocking means 84.

Figure 18:
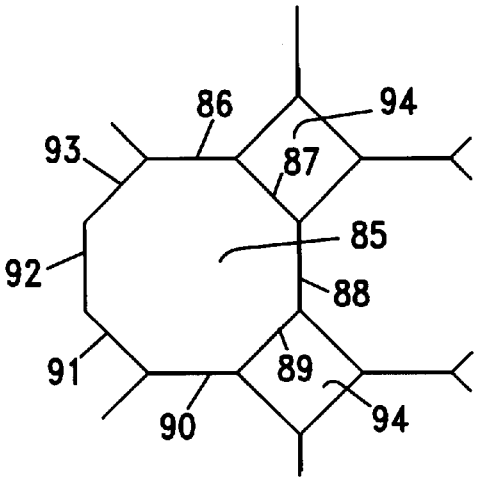
FIG. 18 is a top view of a plurality of yet another configuration of the tile of the present invention.

FIG. 18 depicts still another non-rectangular shaped tile 85. Tile 85 is octagonal having eight sides 86, 87, 88, 89, 90, 91, 92 and 93. In order to fill in the blanks between the octagonal tiles, square tiles 94 are inserted.

The effect of the two level surfaces of the present flooring on puck friction was tested in comparison with the following surfaces:

1. Wood with urethane finish (typical "roller rink" surface).
2. Cement with a Teflon coating (typical tennis court converted for roller hockey).
3. Roll-on (Cement slab covered with multiple coats of high gloss epoxy).
4. Sport Court brand of square plastic snap-together tiles with a single surface.

The goal kept in mind during the creation of the new flooring surface of the present invention is to speed up the game by providing the minimum of resistance for the puck while still having a relatively high resistance to the skater's wheels during turning.

A device was created that had a weighted pendulum which was lifted to a specific height. The pendulum was released and allowed to swing freely, striking a puck at the most vertical position of the pendulum. The distance of travel of the puck was measured and recorded. Three different designs of commonly used pucks were tested and each puck was marked at its striking point so that each puck was struck at the same point on each of the different floors. The striking device was moved to each floor tested. The pucks were all hit from the same spot at the center court line. Each puck was struck twelve times. The high and low measurement were discarded and an average of the ten remaining hits was calculated. The results are shown in Table 1:

TABLE 1

| LOCATION | JOFA RHI PUCK | MACH 1 | JOFA B/W |
|---|---|---|---|
| 1. Tennis Court | 20.58' | 21.06' | 20.35' |
| 2. Wood/Urethane | 20.62' | 17.45' | 19.27' |
| 3. Roll-On/Epoxy | 24.49' | 22.94' | 22.07' |
| 4. Sport Court/Plastic | 27.30 | 24.57' | 30.82' |
| 5. Present Invention | 29.22' | 28.39' | 36.12' |

How much farther (percentage) the puck went on the floor of the present invention vs.:

| | | | |
|---|---|---|---|
| 1. Tennis Court | 42% | 35% | 78% |
| 2. Wood/Urethane | 42% | 63% | 87% |
| 3. Roll-On/Epoxy | 19% | 24% | 64% |
| 4. Sport Court/Plastic | 7% | 15% | 17% |

It is believed that the flooring of the present invention provides an ideal combination of puck speed and skater control.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A modular flooring surface freely supportable on an upper surface of a flat floor, said modular flooring surface being of the type being made essentially from a plurality of shaped tiles, each tile having an upper surface plate having an upper play surface and said upper surface plate having means for supporting the upper play surface on said upper surface of a flat floor and said each tile being attachable to adjacent tiles to form a modular floor, wherein the improvement comprises:

an upper play surface (25) having a lower play surface portion (50') and an upper play surface portion (50), said lower play surface portion (50') lying in a lower plane so that a wheel (55) of an inline skate will be supported in part by said lower play surface portion (50') and a raised design having a flat upper surface comprising said upper play surface portion (50) formed over essentially the entire upper play surface of said tiles comprising raised members extending above said lower play surface portion (50') to said upper play surface portion (50), said upper play surface portion extending from about 0.001" to 0.003" above said lower play surface portion (50') and said raised design being configured so that a runner (53) of a puck will ride on the upper play surface portion (50) and will not touch the lower play surface portion (50').

2. The modular flooring surface of claim 1 wherein said design is a random reverse cobblestone design.

3. The modular flooring surface of claim 1 wherein said design is a reverse square design.

4. The modular flooring surface of claim 1 wherein said lower play surface portion has a roughened surface.

5. The modular flooring surface of claim 1 wherein said upper play surface portion comprise less than 50% of the area of said upper play surface.

6. The modular flooring surface of claim 1 wherein said raised design is comprised of a plurality of members having rectangular upper surfaces and have a width of about 0.020".

7. The modular flooring surface of claim 1 wherein said flat upper surface of said raised design is smooth.

8. A modular flooring surface freely supportable on the upper surface of a flat floor, said modular flooring surface being of the type being made from a plurality of shaped tiles, each tile having an upper surface plate having an upper play surface and said upper surface plate having means for supporting the upper play surface on said upper surface of a flat floor means for supporting the upper play surface extending downwardly from said upper surface plate, and said each tile being divisible into a north half and a south half, and said north half having outwardly extending interlocking members and said south half having inwardly extending interlocking members lockable in an adjacent manner with the outwardly extending interlocking members of an adjacent tile, wherein the improvement comprises:

said outwardly extending interlocking members include a frusto-conical opening extending therethrough with a wider portion being on an upper surface of said interlocking members and said inwardly extending interlocking members include a peg shaped to fit snugly into a lowermost portion of said frusto-conical opening and wherein said outwardly extending interlocking members further include a slot having an inner edge beginning below an edge of said upper surface plate and said inwardly extending interlocking members include a tab with an outwardly extending catch which snaps into said inner edge of said slot of said outwardly extending interlocking members.

9. A tile for use in roller hockey, said tile having sides and having means on each side for interlocking to an adjacent tile and said tile having a generally flat upper play surface without openings therethrough wherein the improvement comprises:

a flat lower portion of said upper play surface; and a raised design extending above said flat lower portion a distance of between 0.001" and 0.004" in height, said raised design covering no more than about 50% of said flat lower portion and said raised design having an upper portion with a flat upper surface.

10. The tile of claim 9 wherein said flat lower portion of said upper play surface is roughened.

11. The tile of claim 10 wherein said flat lower portion of said upper play surface has a sand blasted surface.

12. The tile of claim 9 wherein said upper surface is smooth.

* * * * *